US010569151B2

(12) United States Patent
Hall

(10) Patent No.: US 10,569,151 B2
(45) Date of Patent: Feb. 25, 2020

(54) SPARRING TRAINING TOOL

(71) Applicant: Clarence V. Hall, Plainfield, NJ (US)

(72) Inventor: Clarence V. Hall, Plainfield, NJ (US)

( * ) Notice: Subject to any disclaimer, the term of this patent is extended or adjusted under 35 U.S.C. 154(b) by 0 days.

(21) Appl. No.: 15/353,983

(22) Filed: Nov. 17, 2016

(65) Prior Publication Data

US 2018/0133575 A1 May 17, 2018

Related U.S. Application Data

(60) Provisional application No. 62/257,275, filed on Nov. 19, 2015, provisional application No. 62/257,279, filed on Nov. 19, 2015, provisional application No. 62/264,301, filed on Dec. 7, 2015, provisional application No. 62/266,605, filed on Dec. 12, 2015, provisional application No. 62/317,623, filed on Apr. 3, 2016, provisional application No. 62/307,562, filed on Mar. 13, 2016, provisional application No. 62/323,802, filed on Apr. 18, 2016.

(51) Int. Cl.

| | |
|---|---|
| ***A63B 69/00*** | (2006.01) |
| ***A63B 69/26*** | (2006.01) |
| ***A63B 69/34*** | (2006.01) |
| ***A63B 71/10*** | (2006.01) |
| ***A63B 71/14*** | (2006.01) |

(52) U.S. Cl.

CPC ..... *A63B 69/26* (2013.01); *A63B 69/004* (2013.01); *A63B 69/34* (2013.01); *A63B 71/10* (2013.01); *A63B 71/145* (2013.01); *A63B 2225/09* (2013.01); *A63B 2244/102* (2013.01)

(58) Field of Classification Search

CPC ..... A63B 69/26; A63B 69/20; A63B 69/34; A63B 69/004; A63B 69/24

See application file for complete search history.

(56) References Cited

U.S. PATENT DOCUMENTS

| | | | | |
|---|---|---|---|---|
| 4,077,624 A * | 3/1978 | Feaser | A63B 69/004 446/236 |
| 4,434,980 A * | 3/1984 | Babineaux | A63B 69/20 482/86 |
| 4,991,231 A * | 2/1991 | Swift | A63B 69/004 2/18 |
| 5,899,835 A * | 5/1999 | Puranda | A63B 69/34 482/83 |
| 5,902,217 A * | 5/1999 | Schechner | A63B 69/201 482/83 |
| 7,591,768 B1 * | 9/2009 | Geeting | A63B 69/004 482/83 |
| 2015/0011365 A1 * | 1/2015 | Nelson | A63B 69/205 482/84 |

* cited by examiner

*Primary Examiner* — Kevin Y Kim

(57) ABSTRACT

A body held sparring device configured for either striking or being hit with the addition of a secondary target. The secondary target is offset from the sparring tool and designed to yield when struck, rather than transmit dangerous torque to the body part holding the sparring tool. Additionally, the sparring tool can further incorporate additional sparring tools, additional secondary targets and or additional control body points.

19 Claims, 12 Drawing Sheets

SPARRING TRAINING TOOL

CROSS-REFERENCE TO RELATED APPLICATIONS

Provisional applications: 62/257,275; 62/257,279; 62/264,301; 62/266,605; 62/317,623; 62/307,562; and 62/323,802.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

FIELD

The present application relates to tools for sparring.

BACKGROUND

One of the tool most often associated with training related to striking an opponent is the punching (or heavy) bag. A punching bag is usually cylindrical, and filled with various materials of corresponding hardness. While a punching bag is great for some punches, it is not designed for someone to practice an upper cut (a punch that travels upwards typically to an opponent's chin or solar plexus). Because the glancing nature of the upper cut on the punching bag, it would cause a significant torque on the wrist of person doing the punching and could lead to significant injury. Torque is the enemy to safety during training.

In order to practice punches such as an uppercut, punching mitts worn on a trainers hands are typically employed. In the case of a punching mitt, the individual practicing the punch is supposed to punch the mitt head on and the person wearing the mitt it is supposed to resist the force of the punch using their hands and arms.

However, as good as the punching mitt is, a single mitt can only be used to practice one punch at a time because it is difficult for an individual absorbing a blow with their body to accurately move to the next position in order to receive the next blow in a combination of punches.

Delivering a blow is not the only time it can be dangerous and lead to injury. Receiving a blow typically for new fighters is a significant source of injury, which is why beginning fighters all wear headgear.

Learning how to "slip" a punch (moving your body out of the way of an opponent's punch so that the opponent's fist just misses you) is an essential skill to learn. But practicing not being punched will inevitably lead to a few occasions when punches are accidentally received, particularly as practice is sped up. The problem is that the trainer is either throwing a punch in the air to the side of the trainee's face or at the trainee's face and the trainee is supposed to move. In the first case the trainer not having a specific target is likely to strike the trainee from time to time or at the very least greatly vary the location of their punches. In the second case, the trainee is highly likely to be struck; however, even when they aren't struck, the trainee has no feedback as to how successful they were at slipping the punch other than whether or not they were hit or not. There is no feedback about the degree of success (e.g. was slipped by inches or fractions of an inch). Note: in order to conserve their energy and also to be able to deliver a counter punch, the fighter ideally wants to slip a punch by the smallest distance possible.

Therefore, there continues to be a need for improved safety and feedback when individuals are practicing striking an opponent.

SUMMARY

In order to overcome the deficiencies in the prior art, systems and methods are described herein.

One aspect of the claimed invention involves a body held sparring device comprising: a structure, and at least one sparring tool, and at least one secondary target. The structure is configured to be a first body control in order to physically engage with a body part of an end user and thereby allow the end user to direct the orientation and direction of motion of the sparring tool. The sparring tool is connected to the structure and the force of a blow related to the sparring tool is substantially transmitted through the structure to the body of the end user. The secondary target is also connected to the structure and is offset with respect to the sparring tool but the secondary target is configured to yield when struck in order to reduce the amount of torque received by the body part through the structure.

These and other aspects described herein present in the claims result in features and/or can provide advantages over current technology.

The advantages and features described herein are a few of the many advantages and features available from representative embodiments and are presented only to assist in understanding the invention. It should be understood that they are not to be considered limitations on the invention as defined by the claims, or limitations on equivalents to the claims. For instance, some of these advantages or features are mutually exclusive or contradictory, in that they cannot be simultaneously present in a single embodiment. Similarly, some advantages are applicable to one aspect of the invention, and inapplicable to others. Thus, the elaborated features and advantages should not be considered dispositive in determining equivalence. Additional features and advantages of the invention will become apparent in the following description, from the drawings, and from the claims.

DETAILED DESCRIPTION

Sparring can be done verbally but for the purposes of this disclosure "sparring" is related to the act of making (or near) physical contact for the purposes of practicing fighting and self-defense skills related to making physical contact with a body part of an opponent. The physical contact can be from one opponent's body part to another, such as person hitting an opponent's chin with his or her fist, or through the use of a sparring tool.

"Sparring tools" for the purposes of this document fall into two categories: tools held by the body part of one opponent and intended to used predominantly for striking another opponent (e.g. boxing glove, jousting stick, sword/foil . . . etc.) or targets also held by a body part of an opponent's body part and intended to be struck (e.g. headgear, boxing mitt, body padding, shin guards . . . etc.). Note that while targets can be used to strike an opponent (e.g. headgear used to head butt someone) and that while tools for sticking can be used defensively (fending off a punch with the side of your glove or parrying with a sword/foil) for the purpose of this document, the concept of categories is presented as an aid in understanding.

With respect to the phrase "held by a body part" (or "body held") the sparring tools can be worn such as a boxing glove, head gear, elbow pads or physically held by grasping with an individual's hand.

What will be described herein is a body held sparring tool incorporating a secondary target, wherein the purpose of the secondary target is to yield when struck in order to reduce the amount of torque transmitted to the body part.

However, before we begin with the description, it is helpful to describe in more detail what is meant by "near physical" contact. Near physical contact can be simply a swing and a miss, such as the case when someone slips a punch, or where a trainer deliberately throws a punch just to the side, in front, or behind the trainee with the intent being to come close to the opponent but not actually make physical contact. The latter is particularly helpful in that full speed sparring can be practiced with a reduced risk of injury, because contact is only made when the trainer accidentally hits the trainee.

Figure 1A:
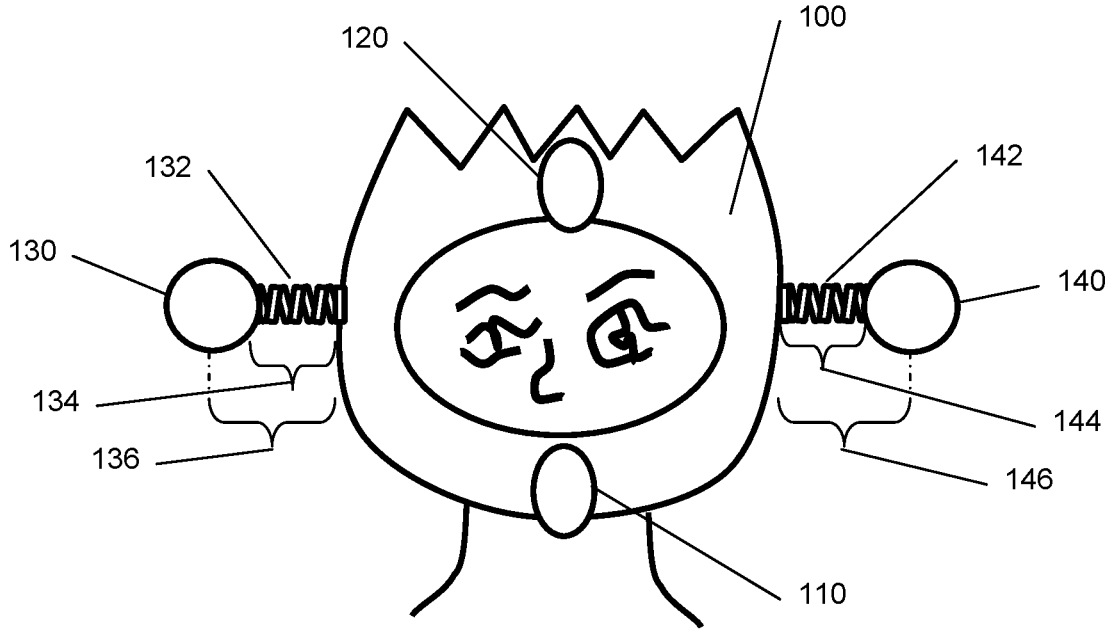
FIG. 1A-B show, in simplified form, a front and side view of a sparring training tool, a sparring helmet, with one or more secondary targets added.
Figure 1B:
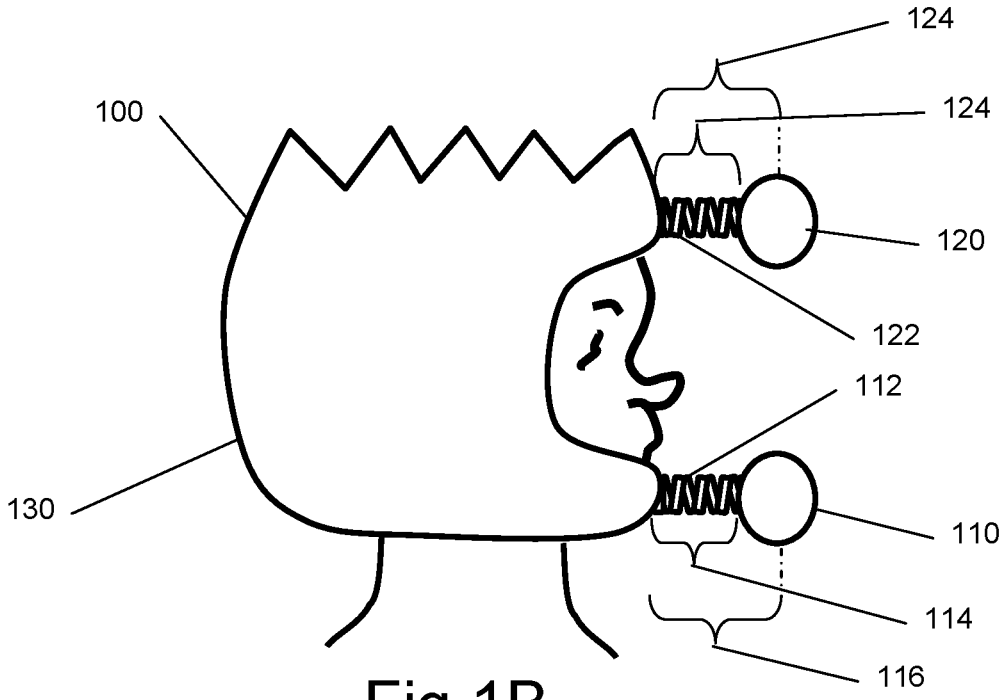

FIG. 1A-B show, in simplified form, a front and side view of a sparring training tool 100, a sparring helmet, with one or more (a plurality of) secondary targets 110, 120, 130, 140 added.

While a sparring tool can have any number of secondary targets, in FIG. 1A-B four secondary targets 110, 120, 130, 140 represented. The secondary targets are associated with the chin 110, forehead 120, right side of the head 130 and left side of the head 140. While these four positions are typically desirable, to practice the range of typical punches, others such as the top of the head, particularly useful when practicing kicks, and the back of the head are also anticipated. Additionally, it can also be useful to further subdivide an area and have multiple secondary targets, such as a left and right side of the chin.

Each of the secondary targets 110, 120, 130, 140 are represented as each being offset 114, 124, 134, 144 from and attached to the sparring training tool 100 by flexible attachment 112, 122, 132, 142. As a result of the offsets 114, 124, 134, 144, the distance to the midline/center 116, 126, 136, 146 for each secondary targets 110, 120, 130, 140 is created, which may or not be a consistent distance for each secondary targets 110, 120, 130, 140. The flexible attachment could be a spring or simply made of a flexible material such as rubber, foam . . . etc. The important factor being that the flexible attachments 112, 122, 132, 142 are designed to yield when struck such that the trainer can strike the target without the bulk of the force of the blow being transmitted to the trainee. On the other hand, if the flexible attachments 112, 122, 132, 142 were not designed to yield then it could be extremely dangerous if the trainer struck one of the secondary targets 110, 120, 130, 140, as the blow would cause a significant torque or twisting of the trainee's body. In this particular case, where the sparring training tool 100 is a sparring helmet, an uppercut to the chin can be damaging enough but an uppercut to a rigid secondary chin target 110 could cause serious whiplash.

Placing a target on a training tool, such as a bullseye target indicating different areas of a chest pad to strike when you are practicing landing blows, would not produce any more torque to the body part than a punch or kick landing directly on the body part without the target. In fact, in the case of protective equipment, the impact of the blow is typically reduced, since the protective equipment is typically designed to reduce the impact of the blow by distributing it over a wider area of the body.

However, it is the fact that the secondary targets are offset/displaced from the sparring training tool that causes the potential for a dangerous torque or twisting to be experienced by the body. Therefore, from a safety perspective it is crucial that the flexible attachments 112, 122, 132, 142 be configured to yield.

With respect to the manner of yielding, flexible attachments such as the already mentioned springs are anticipated but so are targets designed to collapse or be destroyed when contact is made. The collapsing (hinged) or destroyed secondary targets can be particularly useful when you are trying to determine just how close the trainer came in landing a blow. For example, a secondary target may only protrude 1" from a sparring training tool and if it was knocked down or destroyed that would indicate that the trainer came within an inch of hitting the trainee.

Whether or not collapsible or destroyable, the amount that the secondary target is offset can be useful to control. As such, it is useful to have secondary targets that are either of varying offsets and/or sizes. With respect to the varying offsets and/or sizes they can be either be fixedly, replaceably or adjustably attached to sparring tool. For boxing, targets that are offset by 2 to 3" or less are particularly useful for sparring with an experienced fighter, because unless they move out of the way they will be hit by a trainer aiming at the midline/center of the secondary target (unless the target is exceptionally large).

For example, a target that is 6" wide (+/−3" from midline) will have a midline/center at 5-6" or less from the sparing tool when an offset of 2 to 3" or less is used. Under these circumstances, someone aiming for the midline/center of the secondary target will not strike the sparring tool if they are barehanded, since a hand is roughly 4" across. On the other hand, if they are wearing a glove then depending on the size/weight of the glove, they will potentially, just glaze the sparring tool.

As a result, for gloved training, a midline (center) for the secondary target of roughly 6" or greater is recommend for training beginners, from 3-6" for intermediate, and 3" or less for advance fighters. However, these ranges will vary by approximately +/−1" depending on glove size and typically reduced by at least 1" for barehanded training, depending on trainer's hand size.

From the discussion above, it should now be clear that how close (proximity) that the trainer comes to also striking the training tool depends on both the distance to the midline/center of the secondary target and on the size of the object striking the target (e.g. gloved hand, bare hand, nunchaku, sword/foil, foot . . . etc.). Controlling for this proximity can be useful for varying training intensions.

If the training intention is to teach someone to move out of the way ("slip a punch") then the midline/center of the target should be such that a trainer, if aiming for the secondary target, will: 1) strike the sparring tool for an experience fighter, 2) will glancing strike of just miss the sparring tool for an intermediate fighter, and 3) typically not strike the sparring tool for the beginner. It is worth noting that the skill/accuracy of the trainer also plays a role. An inexperience trainer that cannot accurately strike the secondary target may need to increase the distance from the sparring tool to the center/midline of the secondary target in order to have the same training intention.

In other situations, for example where the training intention is different, such as where the training intention is for the trainee to practice a counter strike or practice delivering combination punches, then, as will be discussed shortly, a fixed rather than a variable distance may be highly desirable.

However, before we delve into that detail, it is useful to introduce the concept of a structure. For the purpose of this document, a structure has two functions. The first is that it provides the physical interface/connection between the sparring tool and the secondary target, which could be as simple as Velcro, or magnets used to connect the secondary target to the sparring tool. The second is that the structure is configured to physically engage with the body of an end user and to direct the orientation and direction of motion of the sparring tool (be a control point). The structure can be incorporated directly into the sparring tool, as seen in FIG. 1A-B, or as part of a secondary component as will be described next in FIG. 2A-B.

Figure 2A:
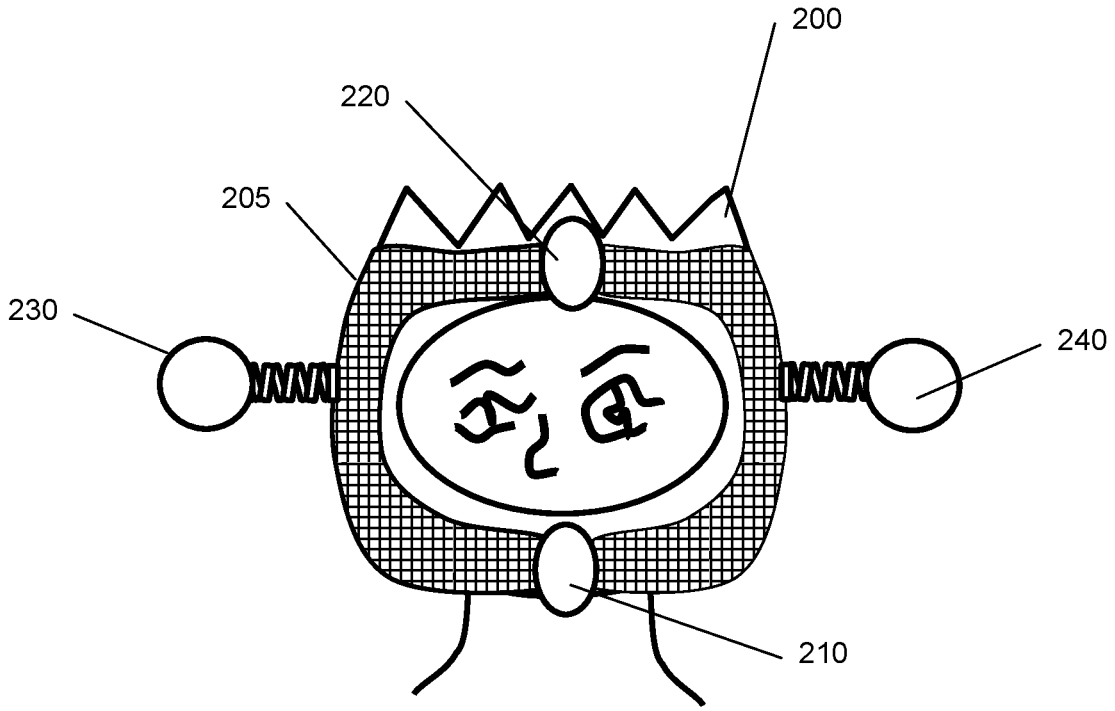
FIG. 2A-B show, in simplified form, a front and side view of a sparring training tool 100, with a secondary component 205 used to create a structure.
Figure 2B:
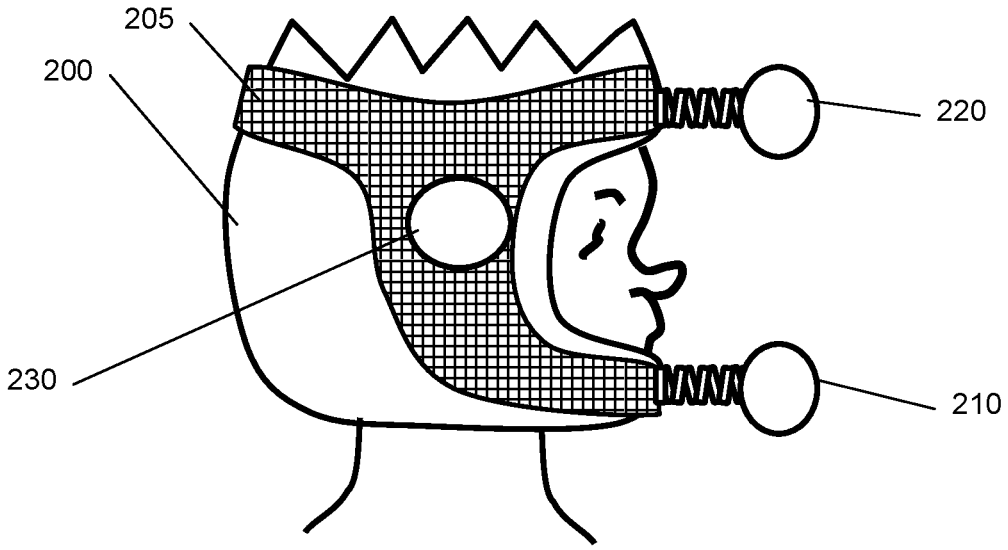

FIG. 2A-B show, in simplified form, a front and side view of a sparring training tool 200, with a secondary component 205 used to create a structure. In this example, a traditional sparring helmet 200 in combination with secondary component 205, attached via strapping, forms a structure to which secondary targets 210, 220, 230, 240 are connected.

The structure formed of the traditional sparring helmet 200 and the secondary component 205 is used to engage with the end user's head and when the end user moves their head they are able to direct the sparring tool where they want it to go because in this particular case they are wearing it.

The point being not the particular structure that is used and whether or not it is incorporated directly into the training tool or utilizes a secondary component but that it serves the duel functions of connecting the secondary target and engaging with the body part. As a result, forces transmitted to the secondary target, offset from the sparring tool, will cause a torque to ultimately be transmitted to the body part.

Other methods of connecting the secondary target to the structure include bolting, screwing, gluing, sewing, clamping, welding and mechanical fits such as an interference or press fit. The important factor not being the manner of connection but that the secondary target is connected such that it is offset from the sparring tool in a manner that allows the secondary target to yield when stuck.

Thus far we have described embodiments where the trainer is striking the secondary target. Embodiments where the trainee would typically be striking the secondary targets will now be discussed.

In embodiments where the trainee would typically be striking the secondary targets the trainer is the one physically engaging with a first tool through a structure in order to direct the first tool and the secondary target is similarly connected to the first tool via the structure. The first tool can be one or more targets or one or more striking tools or a combination of one or more of both. To help illustrate these embodiments several variations will now be presented.

Figure 3A:
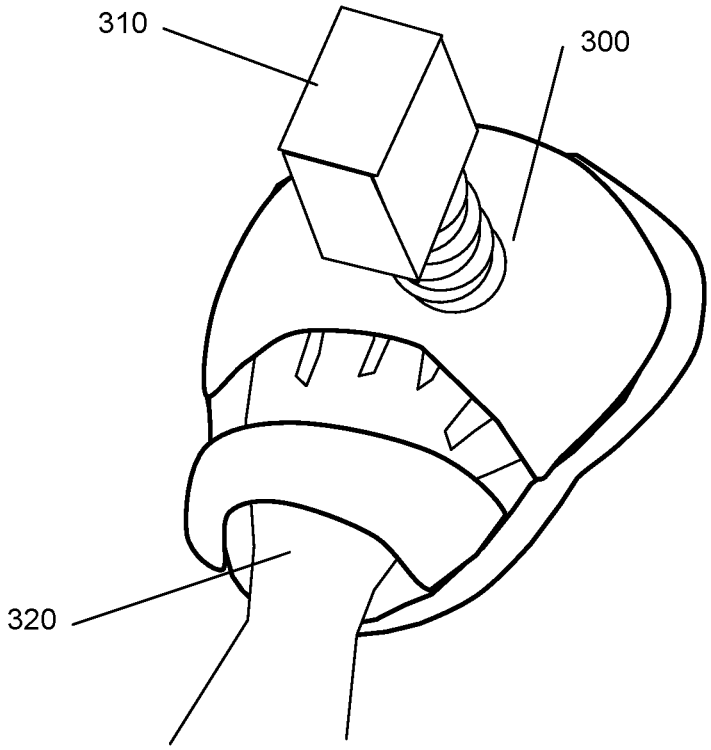
FIG. 3A-B show, in simplified form, a boxing mitt with a secondary target.
Figure 3B:
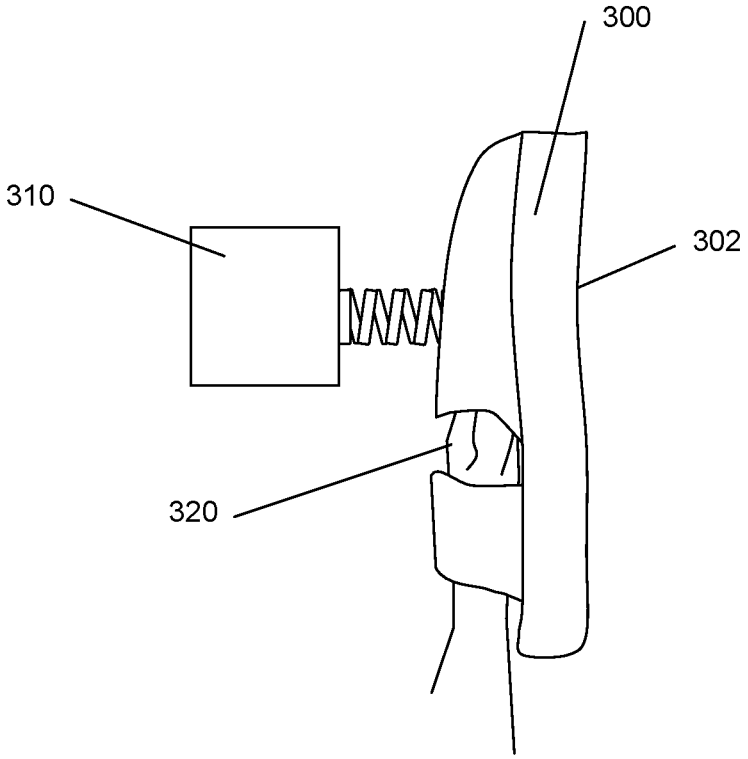

We will begin by discussing the case where the first tool is a target as exemplified in FIG. 3A-B. FIG. 3A-B show, in simplified form, a boxing mitt 300 with a secondary target 310, in perspective and side view respectively. If FIG. 3A we see a boxing mitt 300, which is device that someone places there hand 320 into in order to direct the front surface 302 of the boxing mitt 300. The front surface 302 of the boxing mitt 300 is used as a first target for the trainee to try and strike and it is an extremely effective tool when practicing single punches but not combinations.

For example, if the trainee wants to practice a right uppercut to the chin the trainer would then hold the boxing mitt out in front of them at chin level and the trainee would then strike it, which works fine. However, in order to practice a right uppercut to the chin in combination with a left hook to the temple, the trainer would either need to lift and rotate the mitt exceedingly fast, which is nearly impossible to do when they are initially focused on resisting the blow from the first punch in the combination. Instead, what is typically done, is the trainer needs incorporate a second boxing mitt that they quickly move into position, while moving the first mitt out of the way and you end up with this unnatural choreographed situation, controlled by the speed of the trainer and not of the trainee.

However, by incorporating the secondary target 310, the trainee can easily practice this combination of punches, without the trainer having move their hand placement or requiring a second hand.

In FIG. 3A-B the secondary target 310 is shown as cube shaped, which is advantageous because you typically useful in training because want to be striking someone "head on" directly to their front or side rather than an angled blow. However, any geometric or organic shaped secondary targets could be utilized. For example, the organic shape of skull is particular useful in practicing the right uppercut to the chin left hook to the temple combination.

Figure 4A:
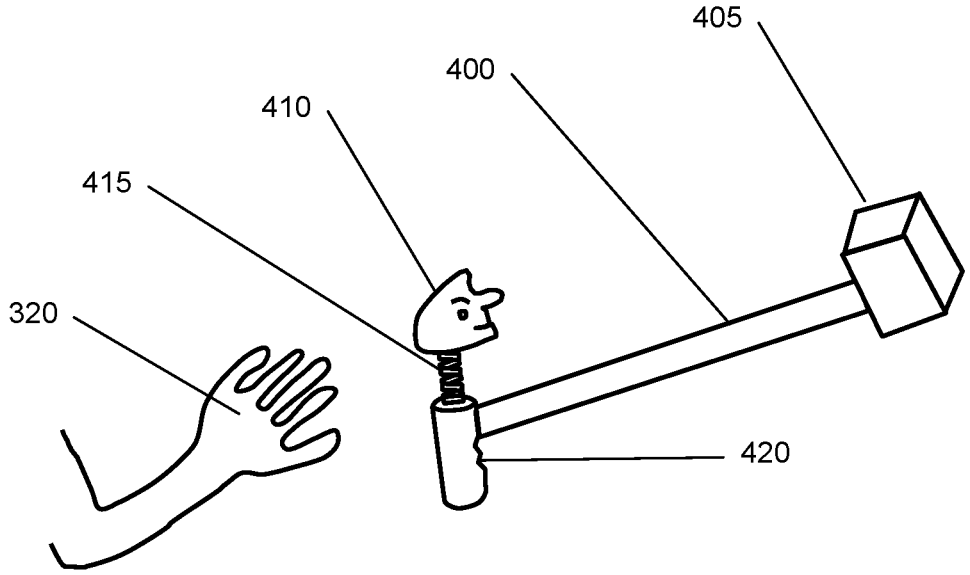
FIG. 4A-B show, in simplified form, a striking tool with a secondary target.
Figure 4B:
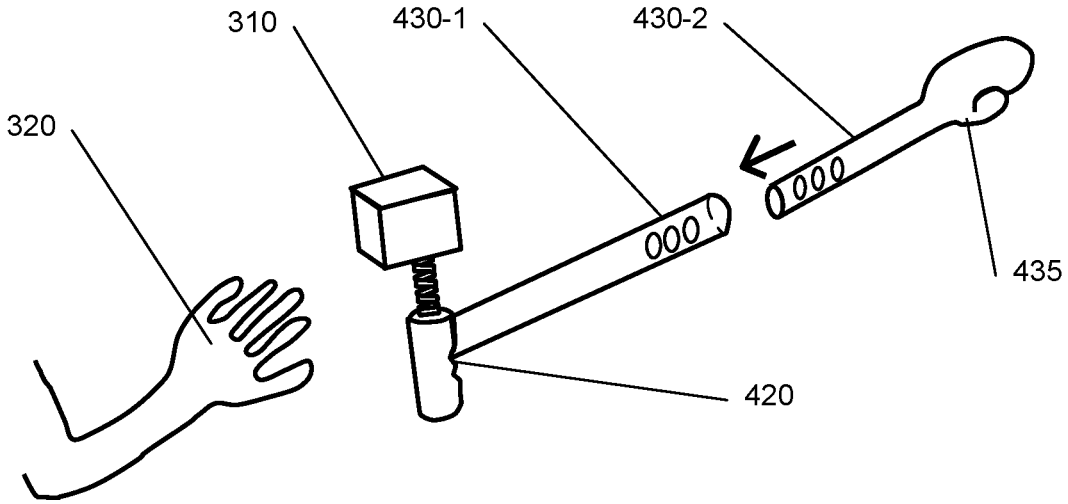

Next, we will turn our attention to discussing the case where the first tool is used for striking, as exemplified in FIG. 4A-B. FIG. 4A-B show, in simplified form, a striking tool 400 with a secondary target 410. In FIG. 4A we see a sparring tool 400, which is used for striking a trainee and has an added cube shaped tip 405. The sparring tool 400 is connected to a structure 420, which in this case is represented to have a handgrip. By grasping the structure 420, with their hand 320, a trainer can direct the sparring tool 400 in order to strike a trainee, as if they were throwing a punch. For example, instead of physically throwing a right jab (and the trainer putting their face in the position that it would normally be struck by a counter punch from the trainee), the trainer could use the sparring tool to simulate throwing that same left jab. However, without the addition of secondary target 410, if the trainee threw the counter punch, where the trainer's face would normally have been, the trainee would be punching into the air.

Instead, by having a secondary target 410 connected to/offset from the structure, the trainee now has a target for their counter punch that is not the trainer's face but, in this specific example, is a face shaped secondary target 410.

However, without the secondary target being configured to yield, via a flexible attachment 415, there would be the potential for a dangerous torque to be applied to the trainer's wrist when the secondary target 410 was struck.

In FIG. 4B we see a variation of the embodiment described in FIG. 4A. In FIG. 4B, the sparing tool is represented as an adjustable length sparring tool made up of a proximal component 430-1, that is attached to the structure 420 and a distal component 430-2 that in this example has a boxing glove shaped tip 435. The proximal 430-1 and distal component 430-2 are configured to adjustably connect to one another in order to achieve sparring tool of specific lengths. Having an adjustable length sparring tool is advantageous because the length can be set to the arm length of an anticipated opponent, which can mean the difference between winning and losing when you finally face the opponent in competition.

In this particular example, when compared to FIG. 4A, the secondary target in FIG. 4B has also been replaced the cube shaped secondary target 310 previously mentioned. [Note: it is to be understood that for the secondary targets and tips any geometric or organic shaped secondary targets could be utilized.]

Figure 5A:
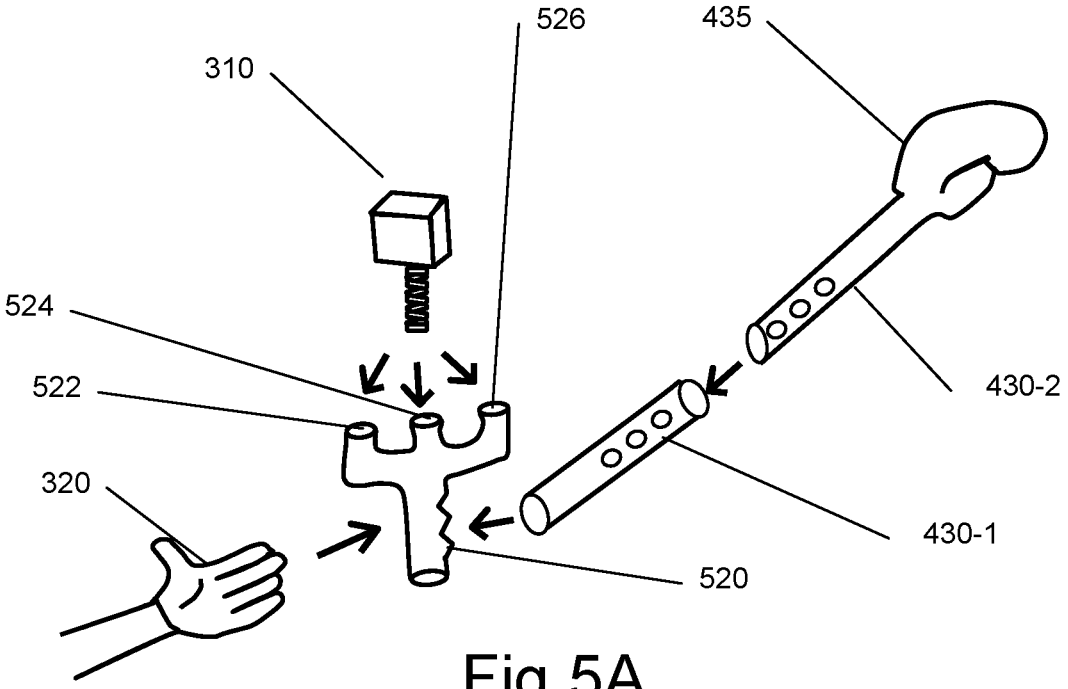
FIG. 5A-B shows, in simplified form, a representative embodiment with multiple secondary targets 510.
Figure 5B:
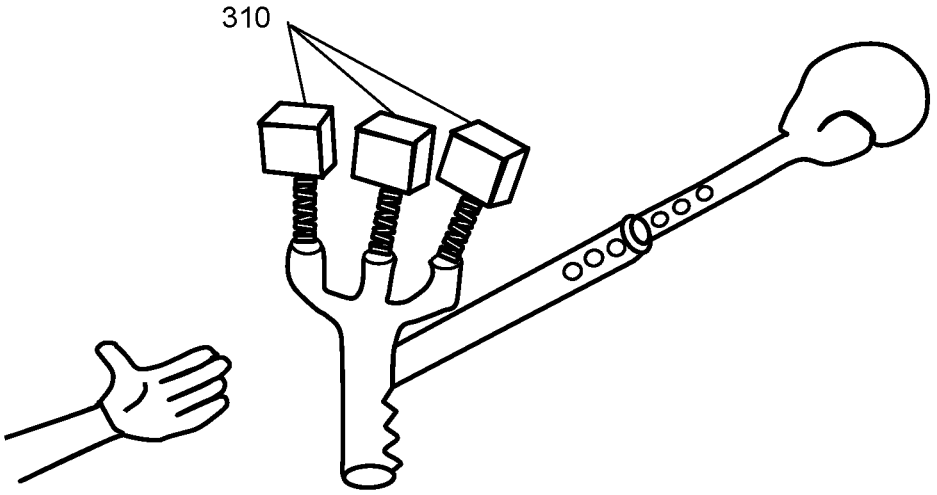

However, there need not be simply one secondary target. In fact, in many situations having two or more secondary targets, as previously discussed, can be extremely useful for sparing purposes. FIG. 5A-B shows, in simplified form, a representative embodiment with multiple secondary targets 510 where the sparring tool is used for striking.

In FIG. 5A we see a configuration similar to 4B. In FIG. 5A, which is represented in exploded view, the sparing tool is represented by the same adjustable length sparring tool made up of the proximal component 430-1, in this case it is attached to a modified structure 520. Additionally, however, the distal component 430-2 is attached to the same boxing glove shaped tip 435. By grasping the structure 520, with their hand 320, a trainer can direct the sparring tool and thereby control the distal component 430-2 of the sparring tool, which is attached to the same boxing glove shaped tip 435.

However, the real difference with the embodiment represented in FIG. 5A-B is that the structure 520 has multiple attachment ports 522, 524, 526 such that multiple secondary targets 510 can be attached.

In FIG. 5B we see that the device has been assembled and in this example three secondary targets 310 have been attached but they need not have been all the same.

Having just discussed multiple secondary targets, we will now turn our attention to embodiments where there are more than one sparring tool combined with at least one secondary target.

FIG. 6A-D show, in simplified form, two or more sparring tools 600, 630 combined with a secondary target 310, in perspective and side view respectively.

Figure 6A:
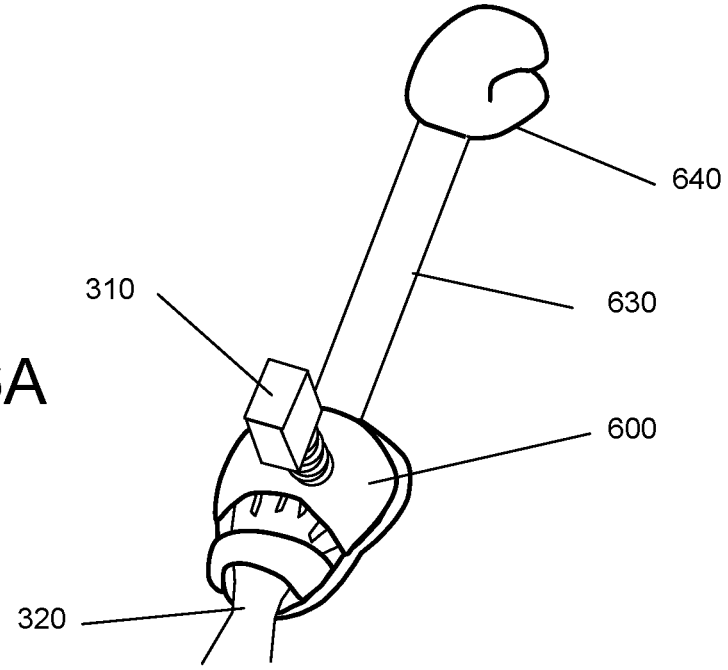
FIG. 6A-D show, in simplified form, two or more sparring tools combined with a secondary target.
Figure 6B:
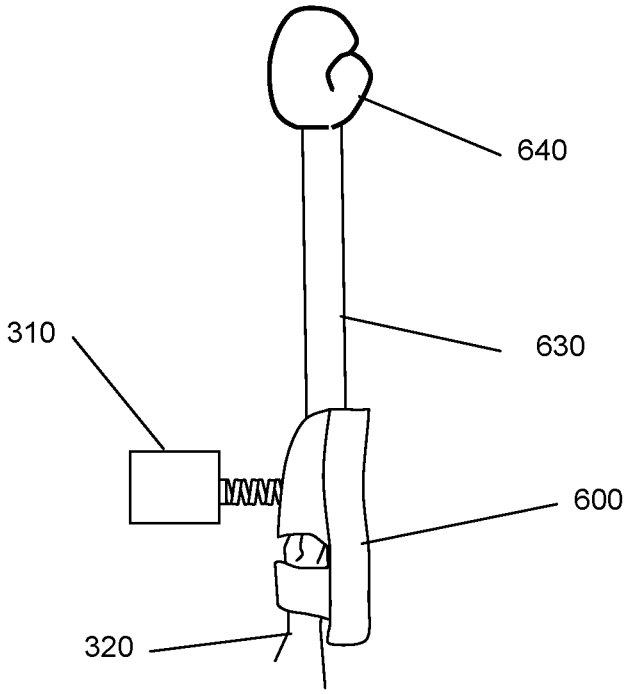

The embodiment in FIG. 6A-B are similar to the embodiments described in FIG. 3A-B; however, the embodiment in FIG. 6A-B has an extra sparing tool 630 protruding from the top of a mitt shaped sparing tool 600. Where the mitt shaped sparing tool 600 is a target, the extra sparring tool 630 is used for striking and has a boxing glove shaped tip 640.

Figure 6C:
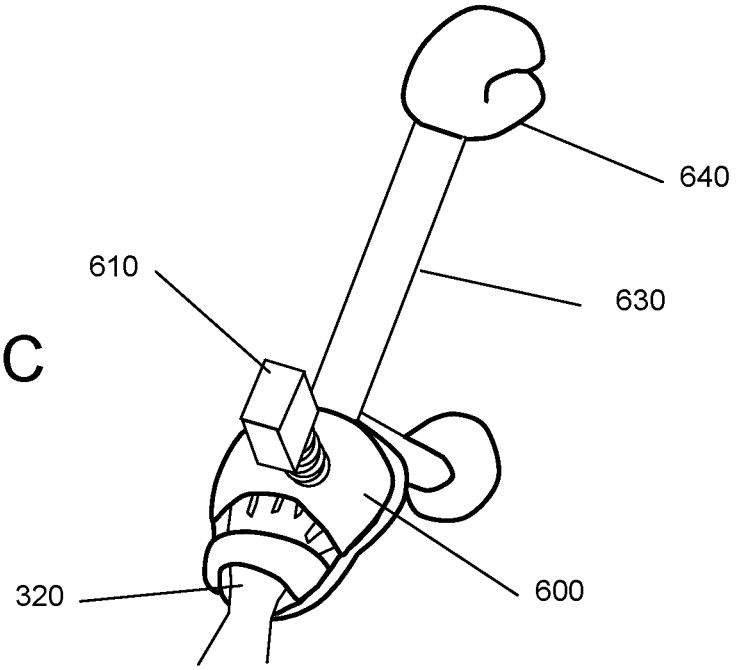
Figure 6D:
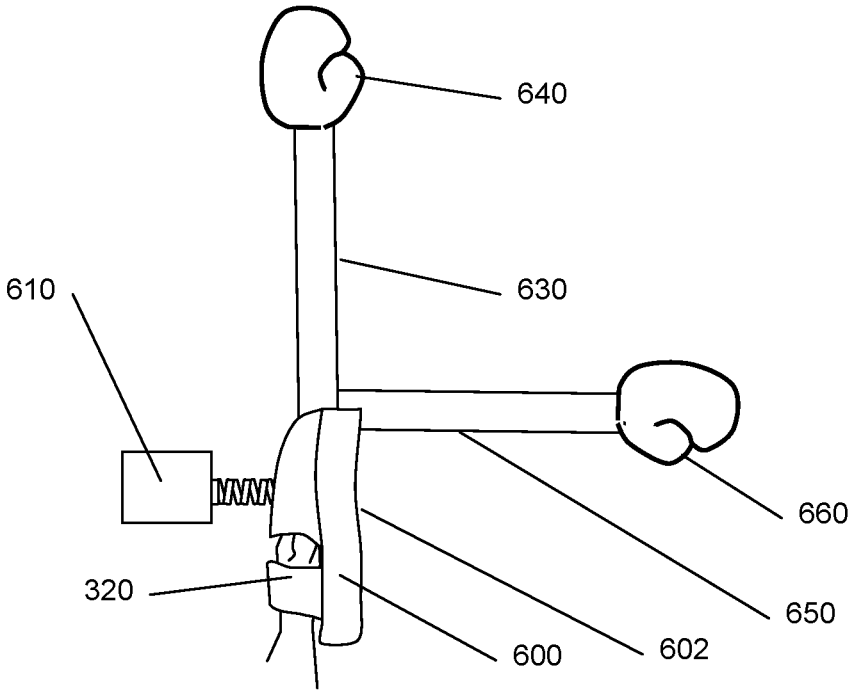

However, the number of additional sparing tools could be an number 1, 2, 3, 4 or more. For example, the embodiment in FIG. 6C-D are similar to the embodiments described in FIG. 6A-B; however, the embodiment in FIG. 6C-D has one additional extra sparing tool 630 protruding substantially perpendicularly to front face 602 of the mitt shaped sparring tool 600, which is similarly equipped with a glove shaped tip 650.

Up to this point, we have been discussing embodiments with one or more secondary targets that projects substantially perpendicular to one or more sparring tools. [Note: other angles both acute and obtuse are also anticipated.] However, aside from projecting secondary targets, suspended secondary targets are incredibly advantageous and will be discussed initially by themselves prior to being shown in embodiments combined with sparring tools.

Figure 7A:
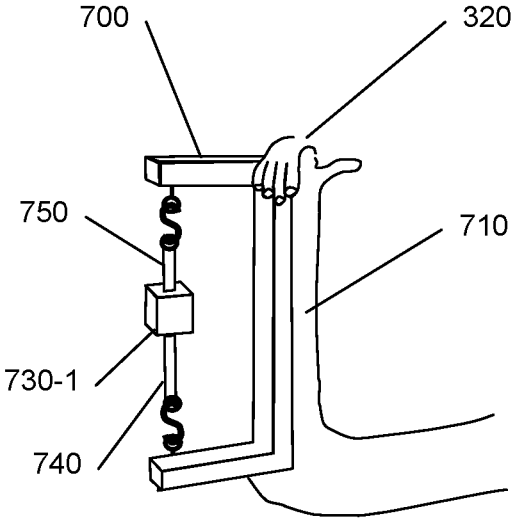
In FIG. 7A-C show, in simplified form, examples of suspended secondary targets.
Figure 7B:
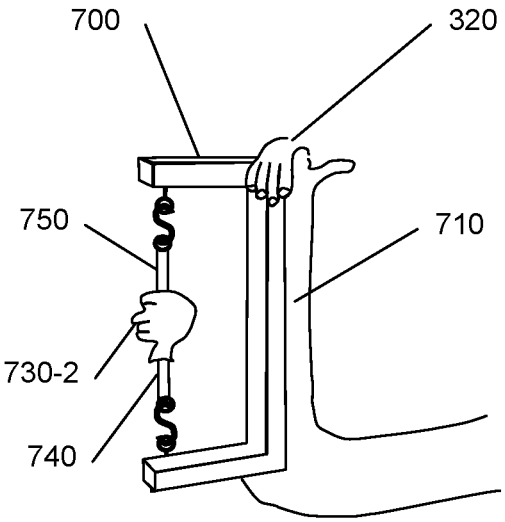

In Fig A-C show, in simplified form, examples of suspended secondary targets. In FIG. 7A we see a "U" shaped structure 700 that, in this example, is held by the trainer's hand 320 and supported by the trainers forearm 710. What is unique is that the "U" shaped structure 700 allows the secondary target 730-1 to be offset between the structure using multiple attachments 750 760 rather than just extending out from it. This advantageously allows the secondary target to yield in multiple directions and adds a component of randomness to the secondary targets motion, as well as being able to be moved around to various locations, given the fact that it is handheld.

The embodiment in Fig B is similar to the embodiments described in Fig A, except the cube shaped secondary target 730-1, in FIG. 7A, has been replaced with a skull shaped secondary target 730-2. Again as previously discussed with projecting targets any geometric or organic shaped target could be utilized.

Figure 7C:
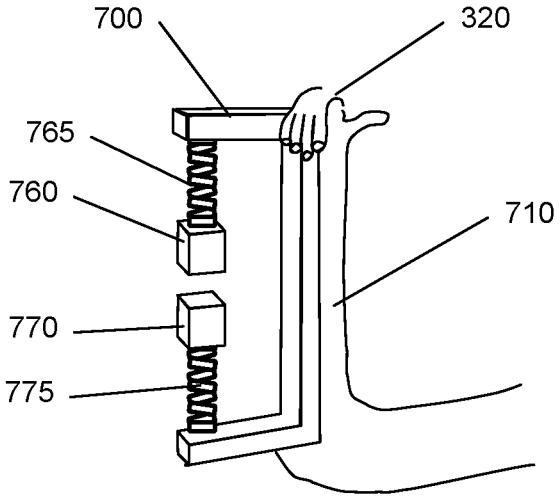

Finally, in order to demonstrate the versatility of the "U" shaped structure 700, in FIG. 7C we see that the secondary target 730-1 and its attachments 740, 750 from FIG. 7A have been removably replaced with two separate projecting secondary targets 760, 770 with individual attachments 775, 765.

Having discussed the benefits of using a "U" shaped structure and suspended secondary targets, embodiments where these combined with one or more sparring tools will now be discussed.

Figure 8A:
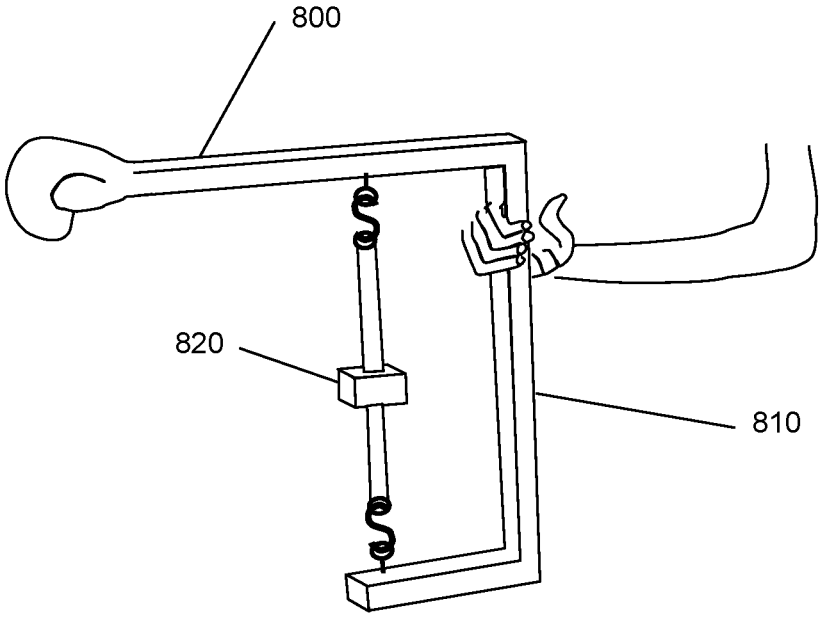
FIG. 8A-B show, in simplified form, examples of suspended secondary targets combined with a sparing tool.
Figure 8B:
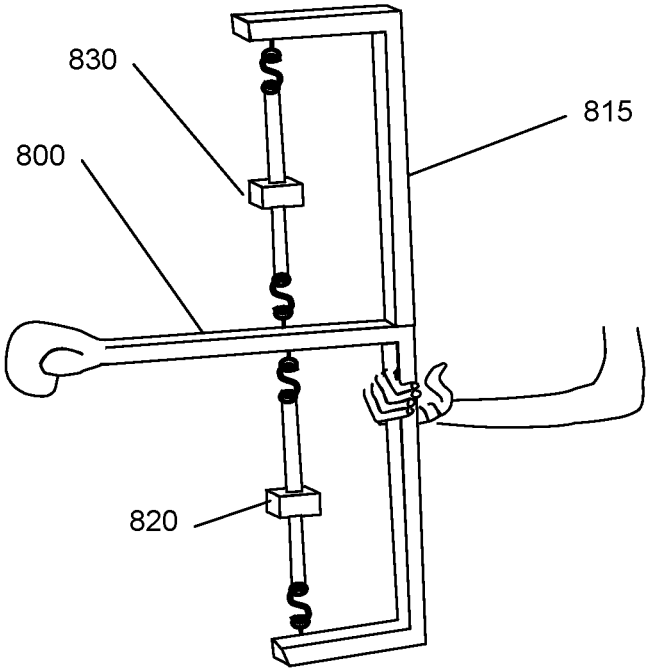

FIG. 8A-B show, in simplified form, examples of suspended secondary targets combined with a sparing tool. In FIG. 8A we see a "U" shaped structure 810 with a single suspended secondary target 820, where also attached to the structure 810 is sparring tool 800. In FIG. 8B we see a double "U" shaped structure 815 with two suspended secondary targets 820, 830.

Figure 9A:
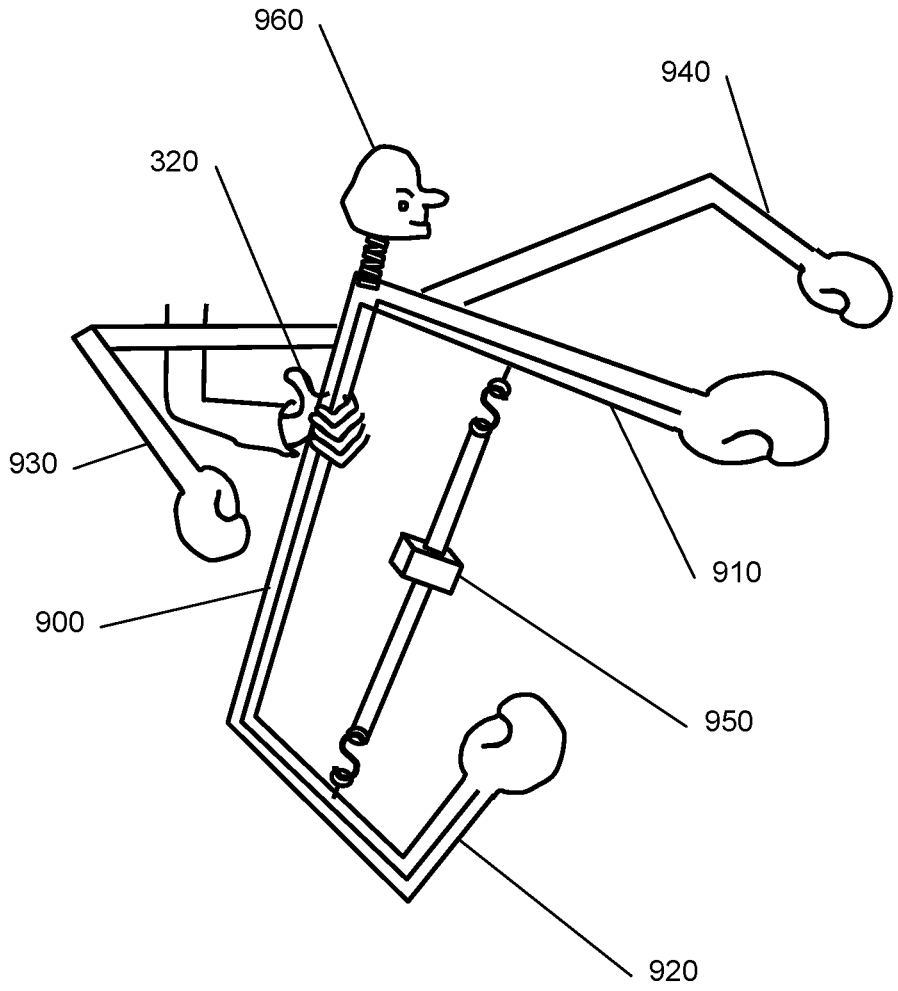
FIG. 9A-C show, in simplified form, examples of a plurality of secondary targets combined with a plurality of sparing tools.
Figure 9B:
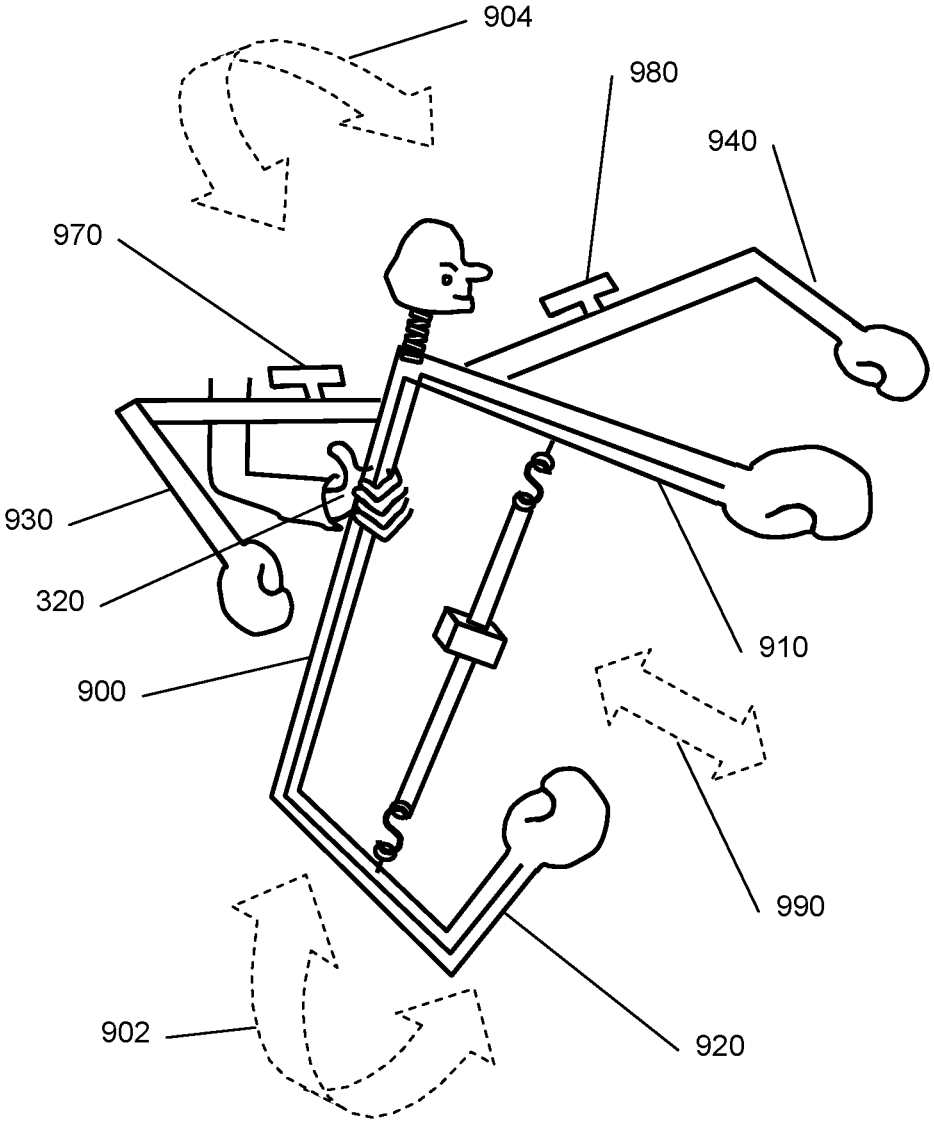
Figure 9C:
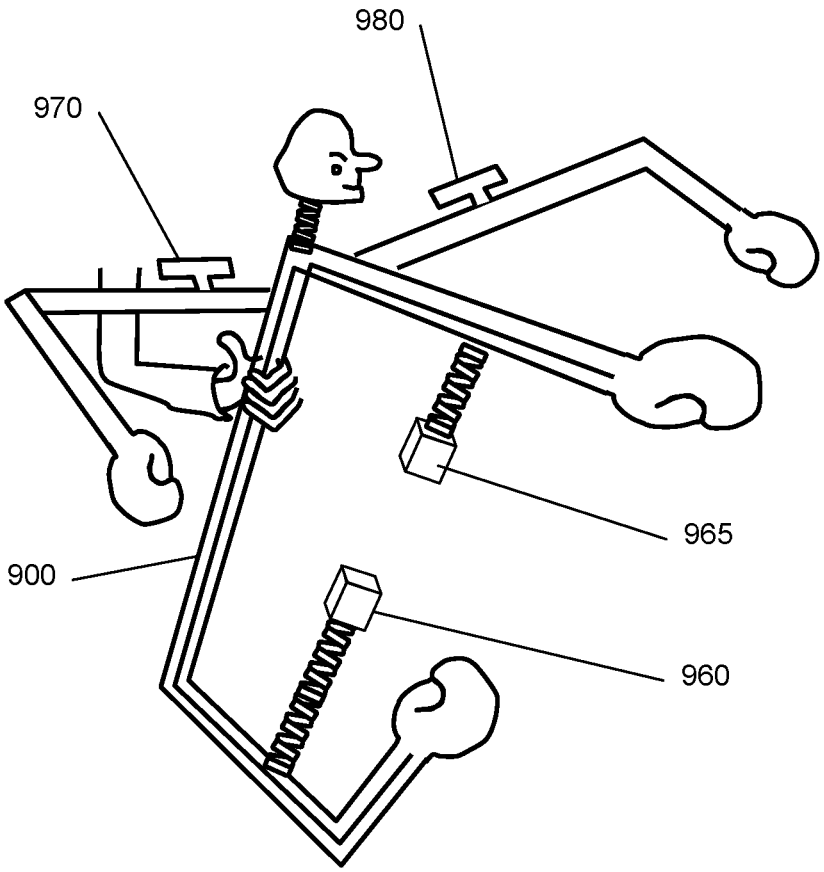

FIG. 9A-B show, in simplified form, examples of a plurality of secondary targets combined with a plurality of sparing tools. In FIG. 9A we see a plurality (four of more in this case) of sparring tools 910, 920, 930, 940 attached to a structure 900. Additionally, attached such they are offset from the structure 900 are a plurality (two or more in this case) of secondary targets 950, 960. In this example, one of those secondary targets 950 is a suspended target and the other of those secondary targets 960 is a projecting secondary target.

Finally, in 9B we introduce the concept of having more than one body control point. Specifically in 9B we can see the addition of a plurality (two or more additional in this case) of body holding control points 970, 980 to allow control by multiple body part. The structure 900 is shown as being held by the user's hand 320 as means of providing body control point. With the addition of one or more body holding control points 970, 980 the user/trainer could use, in this example a second hand (not shown) or one of their shoulders (not shown) to direct the motion of the sparring tools 910, 920, 930, 940. In practice, when there are multiple body control points, one of the body holding control points would be used to predominantly direct the sparing tools 910, 920, 930, 940 towards or away from the opponent in a jabbing motion 990 and another would be used direct the sparing tools 910, 920, 930, 940 in a hooking motion 902, 904.

Finally, it is to be understood that various different variants of the invention, including representative embodiments and extensions have been presented to assist in understanding the invention. It should be understood that such implementations are not to be considered limitations on either the invention or equivalents except to the extent they are expressly in the claims. It should therefore be understood that, for the convenience of the reader, the above description has only focused on a representative sample of all possible embodiments, a sample that teaches the principles of the invention. The description has not attempted to exhaustively enumerate all possible permutations, combinations or variations of the invention, since others will necessarily arise out of combining aspects of different variants described herein to form new variants, through the use of particular hardware or software, or through specific types of applications in which the invention can be used. That alternate embodiments may not have been presented for a specific portion of the description, or that further undescribed alternate or variant embodiments may be available for a portion of the invention, is not to be considered a disclaimer of those alternate or variant embodiments to the extent they also incorporate the minimum essential aspects of the invention, as claimed in the appended claims, or an equivalent thereof.

What is claimed:

1. A body held sparring device comprising: a U-shaped structure, at least a first sparring tool, and at least a first target;

wherein the U-shaped structure has at least a first body control point and a first and second extensions, wherein the first and second extensions are offset from one another and extending outward from the body control point;

wherein the at least first body control point is configured to physically engage with a body part of an end user and thereby allow the end user to direct the orientation and direction of motion of the first sparring tool;

wherein the first sparring tool is connected to the first extension distal, from the at least first body control point and the force of a blow related to the first sparring tool is substantially transmitted through the structure to the body part;

wherein the first target is connected such that it projects between the first and second extensions and is offset, in the direction of the at least first body control point, with respect to the first sparring tool and wherein the first target is configured to yield when struck to reduce the amount of torque received by the body part through the structure;

wherein the U-shaped structure is a double U-shaped structure comprising:

a second body control point extending out from the first extension;

a third extension connected to the second body control point, distal from the first extension, and wherein the third extension projects outward from the second body control point in the same direction as the first extension; and at least a second target connected such that it projects between the first and third extensions and is offset, in the direction of the second body control point, with respect to the first sparring tool and wherein the second first target is configured to yield when struck to reduce the amount of torque received by the body part through the structure.

2. The device of claim 1 wherein the first sparring tool is a sparring tool configured to be hit by an opponent.

3. The device of claim 2 further comprising at least a second sparring tool and wherein the second sparring tool is configured to be hit by an opponent.

4. The device of claim 2 further comprising at least a second sparring tool and wherein the second tool is configured to hit an opponent.

5. The device of claim 1 wherein the U-structure is incorporated directly into the first sparring tool.

6. The device of claim 1 wherein the first target is a suspended target.

7. The device of claim 1 wherein the first sparring tool is a sparring tool configured to hit an opponent.

8. The device of claim 7 further comprising at least a second sparring tool and wherein the second tool is configured to be hit by an opponent.

9. The device of claim 7 further comprising at least a second sparring tool and wherein the second tool is configured to hit an opponent.

10. The device of claim 1 further comprising at least a second sparring tool and wherein the second tool projects substantially perpendicular to the first sparring tool.

11. The device of claim 1 wherein the structure further comprises at least a second body control point.

12. The device of claim 1 further comprising a second target wherein the second target is also connected such that it projects between the first and second extensions and is offset in the direction of the at least first body control point with respect to the first sparring tool and the second target is configured to yield when struck to reduce the amount of torque received by the body part through the structure and wherein the second target is connected to the second extension and the first target is connected to the second extension.

13. The device of claim 12 further comprising at least a second sparring tool and wherein the second tool projects substantially perpendicular to the first sparring tool.

14. The device of claim 13 wherein the second sparring tool is configured to be hit by an opponent.

15. The device of claim 13 wherein the second sparring tool is configured to hit an opponent.

16. The device of claim 1 further comprising a third target wherein the third target is also connected such that it projects between the first and second extensions and is offset in the direction of the at least first body control point with respect to the first sparring tool and the third target is configured to yield when struck to reduce the amount of torque received by the body part through the structure and wherein the third target is connected to the second extension and the first target is connected to the second extension.

17. The device of claim 12 further comprising at least a second sparring tool and wherein the second tool projects substantially perpendicular to the first sparring tool.

18. The device of claim 13 wherein the second sparring tool is configured to be hit by an opponent.

19. The device of claim 13 wherein the second sparring tool is configured to hit an opponent.

* * * * *